United States Patent [19]

Wemyss

[11] 4,259,819

[45] Apr. 7, 1981

[54] METHOD AND APPARATUS FOR ANCHORING SHEET MATERIAL TO A FRAMEWORK

[76] Inventor: George A. Wemyss, 12 Regis Ct., Whitehouse Rd., Barnton, Edinburgh, Scotland

[21] Appl. No.: 948,855

[22] Filed: Oct. 5, 1978

[30] Foreign Application Priority Data

Oct. 14, 1977 [GB] United Kingdom ..... 42853/77

[51] Int. Cl.[3] ..... E04B 1/00

[52] U.S. Cl. ..... 52/222; 52/86; 52/273; 52/741

[58] Field of Search ..... 52/63, 222, 86, 273, 52/741; 135/DIG. 1, DIG. 4, DIG. 6; 160/66, 120, 201, 208, 270, 271, 267, 268 R, 268 S, 272

[56] References Cited

U.S. PATENT DOCUMENTS

| | | | |
|---|---|---|---|
| 1,106,624 | 8/1914 | Cadwallader et al. | 135/DIG. 4 |
| 2,199,127 | 4/1940 | Clearmont | 135/DIG. 5 |
| 2,827,138 | 3/1958 | Roy, Jr. | 52/222 X |
| 3,240,217 | 3/1966 | Bird et al. | 52/86 X |
| 3,430,677 | 3/1969 | Pierce | 160/271 X |
| 4,137,687 | 2/1979 | Sprung | 52/86 X |

FOREIGN PATENT DOCUMENTS

| | | | |
|---|---|---|---|
| 2559416 | 10/1976 | Fed. Rep. of Germany | 52/63 |

*Primary Examiner*—Price C. Faw, Jr.
*Assistant Examiner*—Carl D. Friedman
*Attorney, Agent, or Firm*—Neil F. Markva

[57] ABSTRACT

The specification discloses a method of anchoring sheet material to a framework constituted by a pair of spaced apart frame members. A respective edge of the sheet is slidably engaged in a groove in each of the frame members in such a manner that the sheet cannot be removed laterally therefrom. The sheet material is stretched by pulling another edge portion of the sheet and anchoring said edge portion with the sheet in a stretched condition.

27 Claims, 4 Drawing Figures

Fig.3
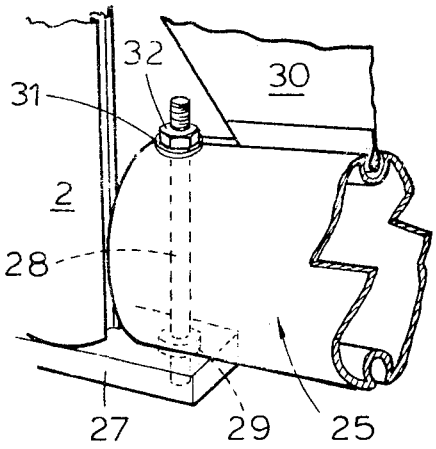
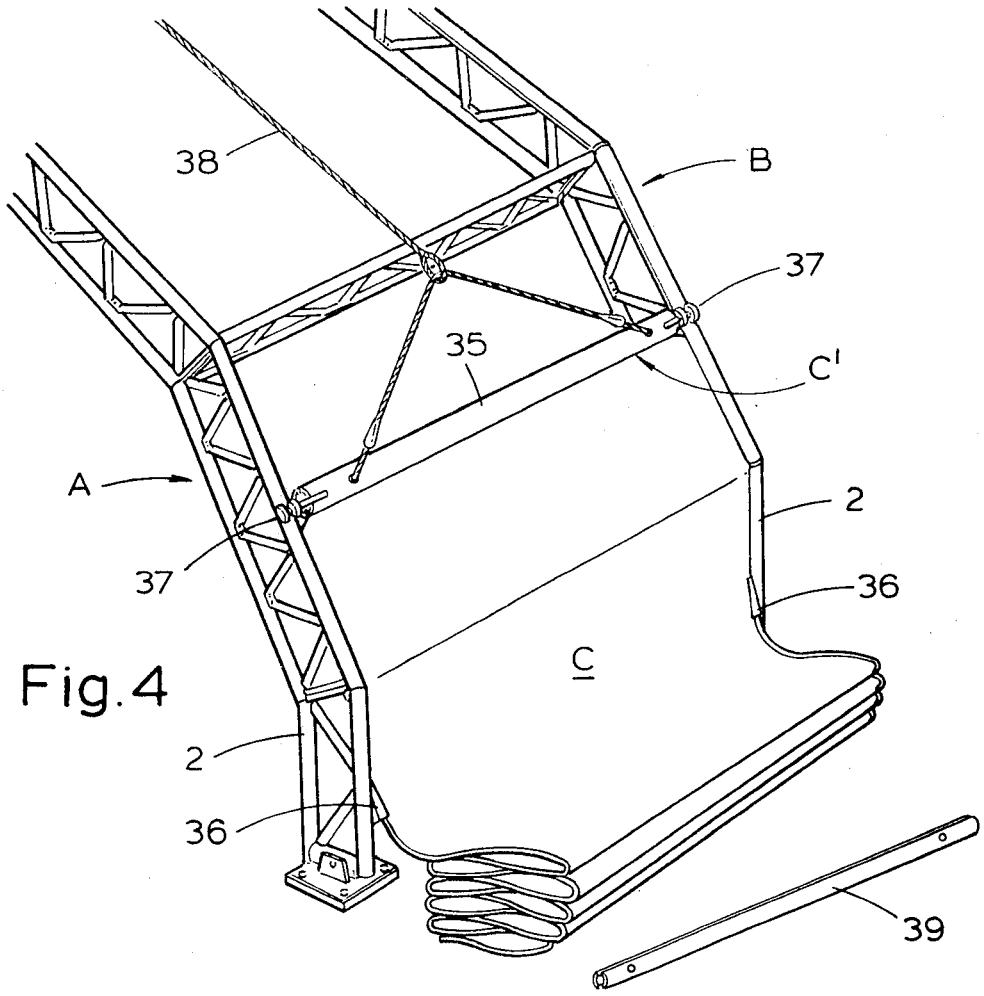
Fig.4

METHOD AND APPARATUS FOR ANCHORING SHEET MATERIAL TO A FRAMEWORK

BACKGROUND TO THE INVENTION

This invention relates to a method of anchoring sheet material to a framework, and in particular to a method of anchoring sheet material to a framework to form a building structure.

The specification of my copending U.S. patent application Ser. No. 850,252, now U.S. Pat. No. 4,150,516, describes building structures having a generally rectangular floor plan and having a framework covered by sheet material. Basically, the framework is, in each case, constituted by a plurality of parallel arches, which extend at right-angles to an axis of symmetry of the floor plan, and end sections. A rectangular strip of material is provided between each pair of adjacent arches, each strip being provided with beading at each of its longer edges, the beading sliding along correspondingly shaped slots in the edges of the arches. In this way, the strip cannot move laterally away from the arches. The end sections of the building are covered in a similar fashion with, for example, triangular pieces of sheet material.

In order to anchor the ends of the strips or sheets of material use has hitherto been made of the traditional way of anchoring the canvas of large tents such as circus tents and marquees. With this method, the ends of each strip are provided with eyelets and are laced to metallic bars of approximately 2½ inch diameter. The bars are then anchored to the ground to hold the ends of the sheets against the ground. This method has proved unsatisfactory in that it is complicated and time-consuming.

Moreover, where two such building structures are joined in a side-by-side relationship, the sheet material is not required to reach the ground but is anchored at a valley gutter above the ground level. The traditional method of securing the ends of the strips of sheet material at this level is also by lacing them to horizontal fixed bars and this is unsatisfactory and time-consuming.

SUMMARY OF THE INVENTION

The present invention provides a method of anchoring sheet material to a framework constituted by a pair of spaced apart frame members, a respective edge of the sheet being slidably engaged in a groove in each of the frame members in such a manner that the sheet cannot be removed laterally therefrom, the method comprising the steps of stretching the sheet material by pulling another edge portion of the sheet and anchoring said edge portion with the sheet in a stretched condition.

Where the frame members are parallel arch members and the sheet is a rectangular strip, each of the two ends of the strip may be anchored in the manner defined above. The method of the invention is therefore, particularly suitable for covering a framework of the type of building structure described in the specification of my copending U.S. Pat. application Ser. No. 850,252.

Preferably, the end portion of the sheet (or each end of the rectangular strip) may be detachably fixed to a bar, in which case the bar is pulled to stretch the sheet, and then the bar is fixed relative to the frame members with the sheet in a stretched condition. Where the sheet is to extend to the ground, the bar may be bolted to plates fixed to the ground. In this case, the bolts may be adjustable so as to vary the amounts of stretch in the sheet.

Alternatively, where the sheet is to terminate at a distance above the ground (for example when it terminates at a valley gutter between two building structures as described above) the or each bar may be detachably fixed to the frame members. Preferably, this is accomplished by providing the frame member with inwardly projecting pins which mate with slots formed in the ends of the corresponding bar. The pins are so positioned that the bar can be slid past the pins so as to stretch the sheet, and so that the slots in the bar can then align with the pins with the sheet still in a stretched condition. This permits the bar to snap into position and so constitutes a simple and reliable method of anchoring the sheet.

The invention also provides a building structure of the type described in the specification of my copending U.S. patent application Ser. No. 850,252 whenever the framework of that structure is covered by sheet material in the manner defined above.

BRIEF DESCRIPTION OF THE DRAWINGS

The invention will now be described in greater detail, by way of example, with reference to the accompanying drawings, in which:

FIG. 3 is a perspective view showing an alternative method of anchoring a sheet at ground level; and FIG. 4 is a perspective view showing a preferred method of introducing a sheet of material between an adjacent pair of arches of the framework.

DESCRIPTION OF PREFERRED EMBODIMENT

Figure 1:
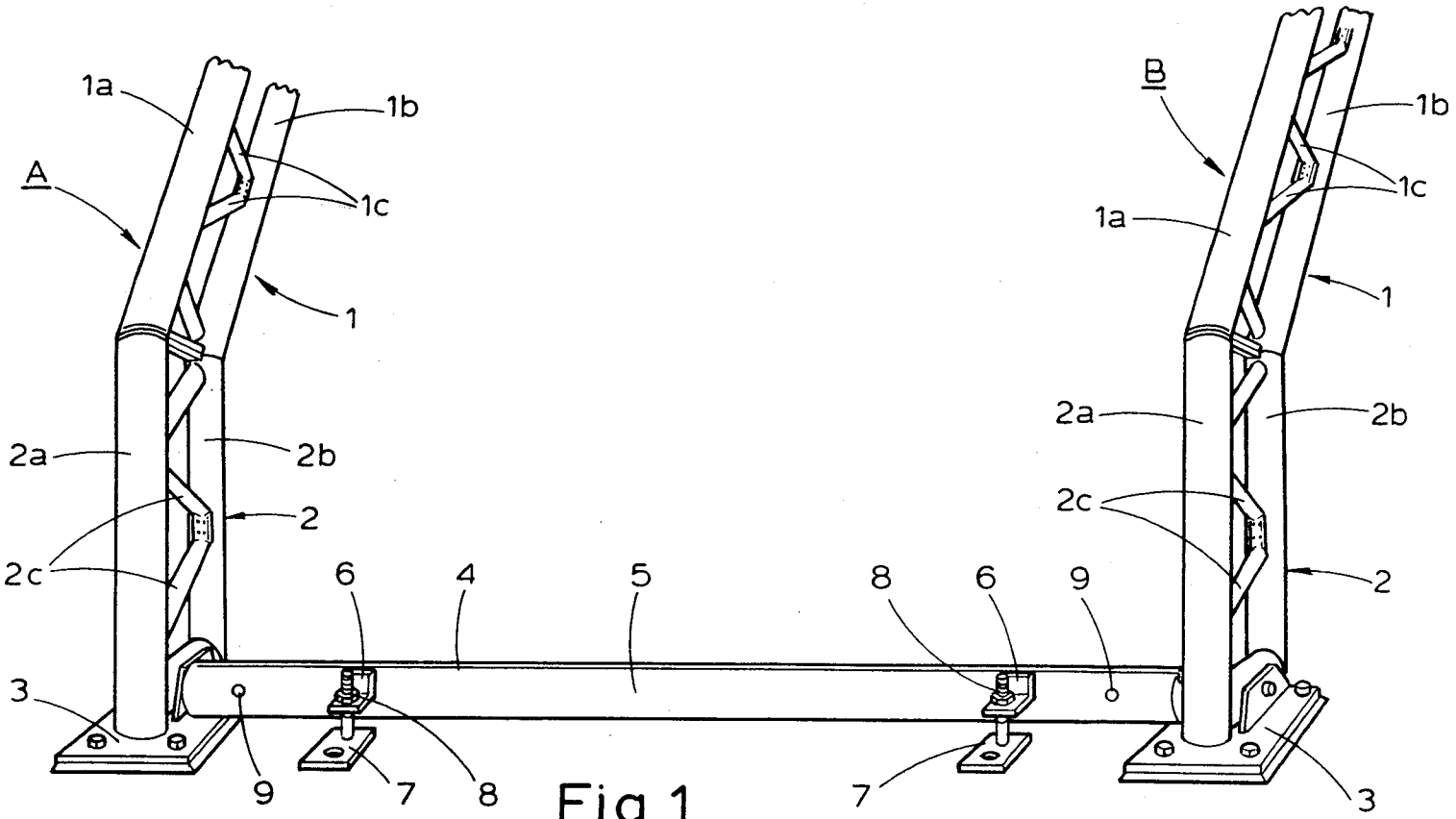
FIG. 1 is a perspective view of part of a sheet of material anchored at ground level, relative to two arch members of a building structure framework.

Referring to the drawings, FIG. 1 shows two adjacent arch members A and B of a building structure framework of the type described in the specification of my copending U.S. patent application Ser. No. 850,252. Each of the arch members A and B is constructed from seven identical struts 1 of mean length 3.6 meters and each end is supported on a short vertical strut 2 of mean length 1.3 meters. Each pair of adjacent struts 1 of each arch A or B are joined together so as to define an inclined angle of 157½°. Each adjacent pair of struts 1 may be joined together by a connector of the type described in the specification of my copending U.S. patent application Ser. No. 899,457. As described in the specification of my copending U.S. patent application Ser. No. 850,252, each of the struts 1 is a compound-braced strut having a front beam 1*a* and a rear beam 1*b* braced together by means of braces 1*c* which criss-cross between the two beams at angles of about 45°. Similarly, the struts 2 are also compound-braced struts having front beams 2*a*, rear beam 2*b* and braces 2*c*.

Each of the struts 2 is fixed to a plate 3 fixed to the ground so as to support the arches A and B in vertical spaced-apart parallel planes. The front beams 1*a* and 2*a* of the struts 1 and 2 are formed with grooves which receive beading formed at the lateral edges of a strip of sheet material which is to cover the space between the two arches A and B. The grooves, beading and strip of sheet material are not shown in the drawing but are also similar to the corresponding parts described in the specification of my copending U.S. patent application Ser. No. 850,252. Each end of the strip of material is also provided with beading which is a sliding fit in a groove 4 formed in a tension bar 5. The groove 4, like the grooves in the beams 1*a*, 2*a* is of complementary shape to the beading so that the strip cannot be removed laterally from the groove. Each tension bar is provided with a pair of brackets 6 which can be fixed to the concrete ground by means of plates 7 and bolts (not shown). The plate 7 can be adjusted relative to the brackets 6 by means of adjustable bolts 8.

In order to anchor the sheet to the two arch members A and B, each end of the sheet is slid into its tension bar 5. One end of the sheet is then threaded into the two grooves at the base of the front beams 2*a* and the entire sheet pulled along the arch members A and B by means of winch ropes and shackles which are connected to the holes 9. The tension bar 5 at the other end of the sheet is fastened to the ground by bolting its plates 7 into the concrete raft which constitutes the ground. The first end of the sheet is then anchored to the ground at the other side of the arch defined by the members A and B and the sheet by bolting its plates 7 into the concrete raft. By making the length of the sheet slightly less than that of the grooves in the front beams 1*a* and 2*a* of the arch members A and B, it is ensured that the sheet is anchored in a stretched condition. Not only does this prevent the sheet flapping in windy conditions, but it also increases the strength of the structure. In the example shown, the groove length is 90 feet and the sheet length is 4 inches shorter than this length.

Obviously, each pair of adjacent arch members of the building structure can be covered in the same way. Moreover, the end sections of the structure, which have triangular shaped strips of sheet material, can be covered in an analogous fashion.

Where two such building structures are constituted side-by-side to form a single building, the sheet material forming the covering does not reach the ground at the join, but ends at a valley gutter formed between the two structures. In this case, the tension bar of each strip of sheet material needs to be fixed directly to the arch members themselves, and FIG. 2 shows one method of accomplishing this.

Figure 2:
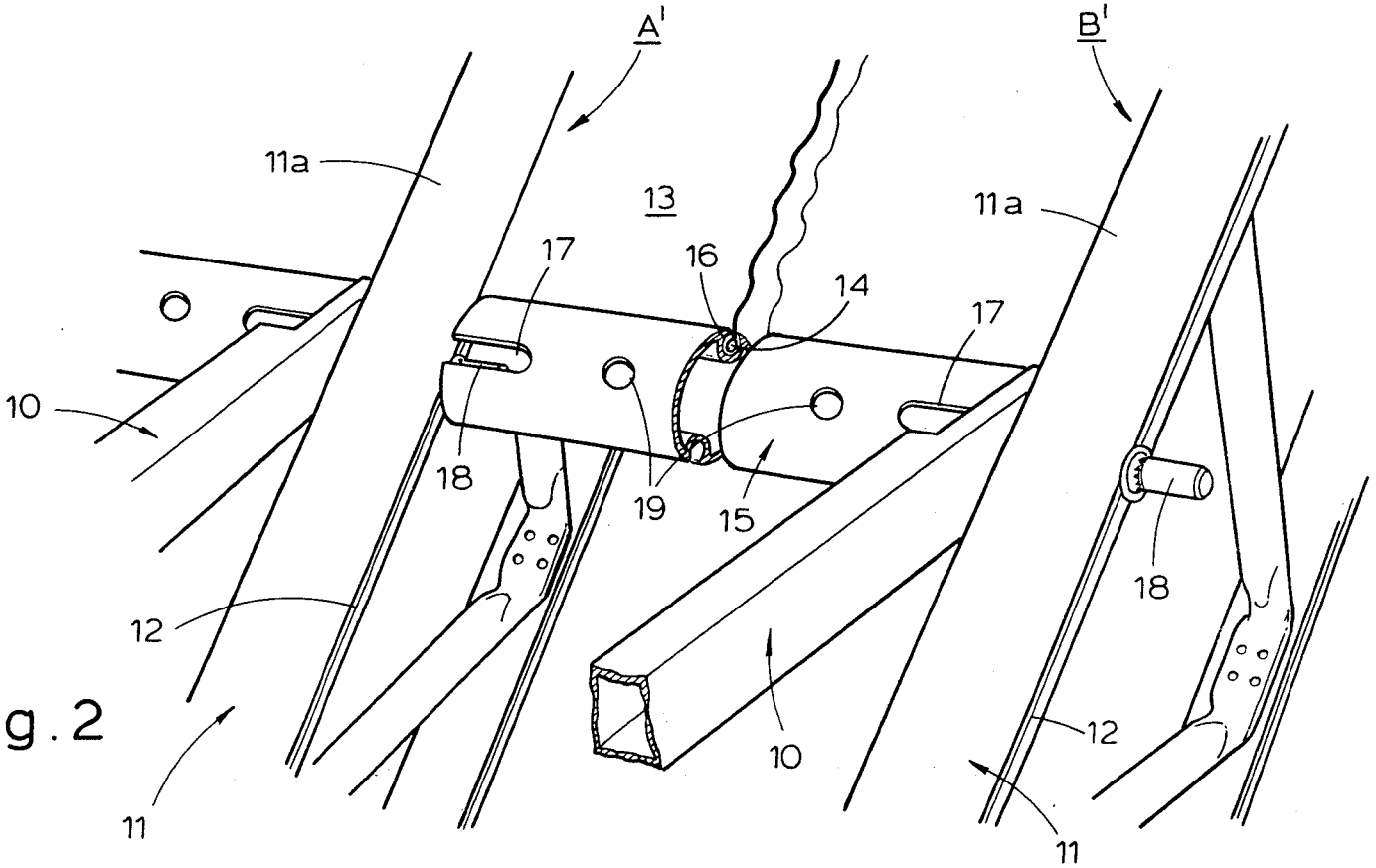
FIG. 2 is a perspective view similar to that of FIG. 1, but showing a sheet anchored to two arch members at a distance above the ground.

Referring now to FIG. 2, the front beams 11*a* of two adjacent arch members A' and B' are shown at the level of a valley gutter formed between two of said adjoining building structures. Struts 10 are provided for supporting the valley gutter (not shown). The struts 11 forming the arch members A' and B' are identical to the struts 1 of the FIG. 1 embodiment and here the grooves 12 for receiving the beading (not shown) at the edges of the strip 13 of sheet material can be seen. The strip 13 also has beading 14 at its end edge, this beading being received as a sliding fit in a groove 16 formed in a tension bar 15. The tension bar 15 is similar to the tension bar 5 of the embodiment of FIG. 1 except that each end of the tension bar 15 is provided with a slot 17, each of which is adapted to mate with a corresponding pin 18 projecting laterally from the adjacent front beam 11*a*. These pins 18 so positioned and the length of the strip 13 is so chosen that, with the other end of the strip anchored in the manner described above with reference to FIG. 1, the strip is slightly stretched when the slots 17 are in register with the pins 18. Thus, to anchor the strip 13, its tension bar 15 is pulled so that the slots 17 pass the pins 18 (holes 19 being provided in the tension bar for receiving the winch ropes and shackles which effect this pulling). The pulling force on the tension bar 15 can then be relaxed so that the tension bar snaps into position with its slots 17 mating with the pins 18. Here again, therefore, the strip 13 is anchored in a stretched condition.

FIG. 3 is a detail view of the strut 2 at the base of an arch member and shows an alternative method of anchoring a tensioning bar 25. The arch is identical to the arch A of FIG. 1 but has a tensioning plate 27 welded to its strut 2, the tensioning plate overlying a ground plate (not shown, but identical to the plate 3 of FIG. 1). An identical tensioning plate (not shown) extends transversely from the strut 2 at its other side. The tensioning plate 27 is drilled and tapped to receive an M12 stud 28 adjacent one end of which is welded a nut 29. In order to anchor a strip 30 of a material fastened to the tension bar 25, the stud 28 is threaded into its tapped hole, until the nut 29 abuts the top of the tensioning plate 27. An identical stud (not shown) is similarly anchored to the tensioning plate (not shown) provided on the ground plate of the adjacent arch. The tension bar 25 is then pulled down (for example by means of a winch) until holes provided therein mate with the studs 28. A washer 31 and a nut 32 are then positioned respectively on each stud 28, and the final tensioning of the strip 30 is accomplished by tightening up the nuts 32, nuts 29 acting as locking nuts during this process. In order to facilitate this final tightening operation, the strip 30 is cut-away at its corners so that a spanner can more easily be engaged with the nuts 32.

Referring to FIG. 4, a modified method of anchoring strips of sheet material will be described. As with the embodiment of FIG. 1, FIG. 4 shows a pair of adjacent arch members A and B and a strip C of sheet material. This strip C of sheet material is identical to that described above with reference to FIG. 1 in that it has beading as its four edges. In order to anchor the strip C to the two arch members A and B, the beading at the leading end C' of the strip is fed into a pulling and fixing bar 35, two longitudinal edges of the strip C having previously been fed into the grooves in the front beams of the base struts 2 of the arch members A and B. Special cloth feed-in tools 36 are used for this purpose. The bar 35 is provided, at each end thereof, with a roller 37 which lifts the bar clear of the front beams of the struts constituting the arch members A and B. These rollers 37 could be replaced by wedges or other lifting devices. The bar 35 is then attached to a winch (not shown) by a winch rope 38 and the strip C is pulled along the arch members A and B. When the lagging end of the strip C is pulled above its required final position, a fixing-down bar 39 is slid onto the beading at the end of the strip, and the bar 39 is anchored to the ground by the method described above with reference to FIG. 1 or by the method described above with reference to FIG. 3. Alternatively, the bar 39 could be anchored at the valley gutter level by the method described with reference to FIG. 2. The strip C is then tensioned using the winch and the bar 35 anchored at the other end of the bay defined by the arch members A and B. Both bars 35 and 39 should be tensioned equally.

It will be apparent that the use of the methods described above results in the anchorage of the sheet material to the framework in such a way that the sheet material is always in a stretched condition. As explained above this has the advantage of reducing flapping in windy conditions and of increasing the strength of the finished building structure. Moreover, the use of these methods reduces the time taken to anchor one strip of material from about 40 minutes to about 2½ minutes.

It will be apparent that a number of modifications could be made to the methods described above. In particular, where very long bars are to be anchored to the ground (for example at the "D" shaped ends of a building structure) it is preferable to provide an additional tensioning device at the center of the bar. Such a device could be of the type shown at 6, 7 and 8 of FIG. 1. Preferably, however, this tensioning device is constituted by a stud which is fitted directly to the ground and anchored in concrete. In practice, a glass phial containing a resin hardener chemical is set in a hole drilled in the concrete. The phial is then broken and its contents mixed. The stud is then positioned vertically in the hole and is fixed in that position by the setting material. The projecting part of the stud can then pass through a hole in the bar and be tensioned by a bolt threaded onto its free end. A stud similar to the stud 28 of FIG. 3 is suitable for this purpose. Moreover, this type of tensioning device would be used in place of that used in the embodiment of FIG. 1.

I claim:

1. A method of anchoring an elongate strip of sheet material, under tension, to a framework constituted by a pair of spaced apart frame members extending upwardly from the ground, the method comprising the steps of:

(a) slidingly engaging the longitudinal edges of the strips in facing grooves formed respectively in each of the frame members in such a manner that the strip cannot be removed laterally therefrom, (b) detachably fixing tension bars to the two end edges of the strip, (c) pulling one of said tension bars to move the strip along said grooves in an unstretched condition until the strip extends under tension substantially the entire length of the frame members, (d) anchoring the end edges of the strip under tension by fixing the tension bars relative to the frame members with the strips in a stretched condition across the width thereof.

2. A method as claimed in claim 1, wherein
the frame members are parallel arch members and the strip is rectangular.

3. A method as claimed in claim 1, wherein
the strip has a length sufficient to extend to the ground, and
each tension bar is bolted to plate 5 fixed to the ground.

4. A method as claimed in claim 3, wherein
the bolts are adjustable so as to vary the amount of stretch in the strip.

5. A method as claimed in claim 1, wherein
the strip has a length sufficient to extend to the ground, and
each tension bar is bolted to plates fixed to the base of the frame members.

6. A method as claimed in claim 1, wherein
the strip terminates at a distance above the ground, and
each tension bar is detachably fixed to the frame members.

7. A method as claimed in claim 6, wherein
the frame members include inwardly projecting pins which mate with slots formed in the ends of the corresponding tension bar.

8. A method as claimed in claim 7, wherein
the pins are so positioned that the corresponding tension bar can be slid past the pins so as to stretch the strip, and so that the slots in that bar then align with said pins with the strip still in a stretched condition.

9. An assembly for anchoring an elongate strip of sheet material to a framework constituted by a pair of spaced apart frame members extending upwardly from the ground, the assembly comprising:

(a) each of the frame members having a groove with a shaped cross-section facing inwardly toward the opposing frame member, (b) an elongate strip of sheet material having two end edges and a shaped longitudinal edge structure adapted to slidingly engage in said facing grooves in an unstretched condition, (c) tension bars detachably connected to the two end edges of the elongate strip, (d) means of pulling one of said tension bars to move the strip along said grooves in the unstretched condition until the strip extends under tension substantially the entire length of the frame members, and (e) means for anchoring the end edges of the strip under tension by fixing the tension bars with respect to the frame members with the strips in a stretched condition.

10. An assembly as claimed in claim 9, wherein
the frame members are parallel arch members and the strip is rectangular.

11. An assembly as claimed in claim 9, wherein
the strip has a length sufficient to extend to the ground, and
each tension bar is bolted to plates fixed to the ground.

12. An assembly as claimed in claim 11, wherein
the bolts are adjustable so as to vary the amount of stretch in the strip.

13. An assembly as claimed in claim 9, wherein
the strip has a length sufficient to extend to the ground, and
each tension bar is bolted to plates fixed to the base of the frame members.

14. An assembly as claimed in claim 9, wherein
the strip terminates at a distance above the ground, and
each tension bar is detachably fixed to the frame members.

15. An assembly as claimed in claim 14, wherein
the frame members include inwardly projecting pins which mate with slots formed in the ends of the corresponding tension bar.

16. An assembly as claimed in claim 15, wherein
the pins are so positioned that the corresponding tension bar can be slid past the pins so as to stretch the strip, and so that the slots in that bar can then align with said pins with the strip still in a stretched condition.

17. A method of anchoring an elongate strip of sheet material to a framework constituted by a pair of spaced apart frame members extending upwardly from the ground, the method comprising the steps of:

(a) slidingly engaging the longitudinal edges of the strips in facing grooves formed respectively in each of the frame members in such a manner that the strip cannot be removed laterally therefrom, (b) detachably fixing tension bars to the two end edges of the strip, (c) pulling one of said tension bars to move the strip along said grooves until the strip extends substantially the entire length of the frame members,
(d) anchoring the end edges of the strip by fixing the tension bars relative to the frame members with the strips in a stretched condition,
(e) the strip has a length sufficient to extend to the ground, and
(f) each tension bar is bolted to plates fixed to the ground.

18. A method as claimed in claim 17, wherein the bolts are adjustable so as to vary the amount of stretch in the strip.

19. A method of anchoring an elongate strip of sheet material to a framework constituted by a pair of spaced apart frame members extending upwardly from the ground, the method comprising the steps of:
(a) slidingly engaging the longitudinal edges of the strips in facing grooves formed respectively in each of the frame members in such a manner that the strip cannot be removed laterally therefrom,
(b) detachably fixing tension bars to the two end edges of the strip,
(c) pulling one of said tension bars to move the strip along said grooves until the strip extends substantially the entire length of the frame members,
(d) anchoring the end edges of the strip by fixing the tension bars relative to the frame members with the strips in a stretched condition,
(e) the strip has a length sufficient to extend to the ground, and
(f) each tension bar is bolted to plates fixed to the base of the frame members.

20. A method of anchoring an elongate strip of sheet material to a framework constituted by a pair of spaced apart frame members extending upwardly from the ground, the method comprising the steps of:
(a) slidingly engaging the longitudinal edges of the strips in facing grooves formed respectively in each of the frame members in such a manner that the strip cannot be removed laterally therefrom,
(b) detachably fixing tension bars to the two end edges of the strip,
(c) pulling one of said tension bars to move the strip along said grooves until the strip extends substantially the entire length of the frame members,
(d) anchoring the end edges of the strip by fixing the tension bars relative to the frame members with the strips in a stretched condition,
(e) the strip terminates at a distance above the ground,
(f) each tension bar is detachably fixed to the frame members, and
(g) the frame members include inwardly projecting pins which mate with slots formed in the ends of the corresponding tension bar.

21. A method as claimed in claim 20, wherein the pins are so positioned that the corresponding tension bar can be slid past the pins so as to stretch the strip, and so that the slots in that bar can then align with said pins with the strip still in a stretched condition.

22. An assembly for anchoring an elongate strip of sheet material to a framework constituted by a pair of spaced apart frame members extending upwardly from the ground, the assembly comprising:
(a) each of the frame members having a groove with a shaped cross-section facing inwardly toward the opposing frame member,
(b) an elongate strip of sheet material having two end edges and a shaped longitudinal edge structure adapted to slidingly engage in said facing grooves,
(c) tension bars detachably connected to the two end edges of the elongate strip,
(d) means of pulling one of said tension bars to move the strip along said grooves until the strip extends substantially the entire length of the frame members, and
(e) means for anchoring the end edges of the strip by fixing the tension bars with respect to the frame members with the strips in a stretched condition,
(f) the strip has a length sufficient to extend to the ground, and
(g) each tension bar is bolted to plates fixed to the ground.

23. An assembly as claimed in claim 22, wherein the bolts are adjustable so as to vary the amount of stretch in the strip.

24. An assembly for anchoring an elongate strip of sheet material to a framework constituted by a pair of spaced apart frame members extending upwardly from the ground, the assembly comprising:
(a) each of the frame members having a groove with a shaped cross-section facing inwardly toward the opposing frame member,
(b) an elongate strip of sheet material having two end edges and a shaped longitudinal edge structure adapted to slidingly engage in said facing grooves,
(c) tension bars detachably connected to the two end edges of the elongate strip,
(d) means of pulling one of said tension bars to move the strip along said grooves until the strip extends substantially the entire length of the frame members,
(e) means for anchoring the end edges of the strip by fixing the tension bars with respect to the frame members with the strips in a stretched condition,
(f) the strip has a length sufficient to extend to the ground, and
(g) each tension bar is bolted to plates fixed to the base of the frame members.

25. An assembly for anchoring an elongate strip of sheet material to a framework constituted by a pair of spaced apart frame members extending upwardly from the ground, the assembly comprising:
(a) each of the frame members having a groove with a shaped cross-section facing inwardly toward the opposing frame member,
(b) an elongate strip of sheet material having two end edges and a shaped longitudinal edge structure adapted to slidingly engage in said facing grooves,
(c) tension bars detachably connected to the two end edges of the elongate strip,
(d) means of pulling one of said tension bars to move the strip along said grooves until the strip extends substantially the entire length of the frame members,
(e) means for anchoring the end edges of the strip by fixing the tension bars with respect to the frame members with the strips in a stretched condition,
(f) the strip terminates at a distance above the ground, and
(g) each tension bar is detachably fixed to the frame members.

26. An assembly as claimed in claim 25, wherein the frame members include inwardly projecting pins which mate with slots formed in the ends of the corresponding tension bar.

27. An assembly as claimed in claim 26, wherein the pins are so positioned that the corresponding tension bar can be slid past the pins so as to stretch the strip, and so that the slots in that bar can then align with said pins with the strip still in a stretched condition.

* * * * *